United States Patent [19]

Albright et al.

[11] 4,002,535

[45] Jan. 11, 1977

[54] PRECONDITIONING TREATMENT OF COAL TO MINIMIZE AGGLOMERATION

[75] Inventors: Charles William Albright, South Charleston; Hubert Greenidge Davis, Charleston, both of W. Va.

[73] Assignee: Union Carbide Corporation, New York, N.Y.

[22] Filed: Dec. 27, 1974

[21] Appl. No.: 536,870

[52] U.S. Cl. ..... 201/9; 201/31; 201/36; 201/42

[51] Int. Cl.[2] ..... C10B 57/08; C10L 9/06

[58] Field of Search ..... 201/9, 20, 31, 36, 42, 201/32

[56] References Cited

UNITED STATES PATENTS

| | | | |
|---|---|---|---|
| 2,815,316 | 12/1957 | Kruppa et al. | 201/9 |
| 3,070,515 | 12/1962 | Sylvander | 201/9 |
| 3,094,487 | 6/1963 | Kruppa | 233/28 |
| 3,337,417 | 8/1967 | Albright | 201/9 |
| 3,357,896 | 12/1967 | Gasior et al. | 201/34 |
| 3,632,479 | 1/1972 | Lee et al. | 201/32 |

FOREIGN PATENTS OR APPLICATIONS

| | | | |
|---|---|---|---|
| 757,083 | 9/1956 | United Kingdom | 201/9 |

*Primary Examiner*—Frank W. Lutter
*Assistant Examiner*—Frank Sever
*Attorney, Agent, or Firm*—Israel Blum

[57] ABSTRACT

A method of preconditioning agglomerating coal particles to substantially prevent agglomeration of a fluid-bed reaction zone in a reactor comprising preheating thd coal particles in dense phase flow, rapidly oxidizing the particles in a vertical standpipe having a regulated thermal environment, pressurizing the particles to a pressure above reactor pressure and introducing the preconditioned coal particles into the fluid-bed reactor zone at substantially reaction pressure for reaction at an elevated temperature and at reaction pressure in the presence of a reagent.

10 Claims, 2 Drawing Figures

PRECONDITIONING TREATMENT OF COAL TO MINIMIZE AGGLOMERATION

FIELD OF THE INVENTION

This invention relates to an improved continuous process for gasifying, hydrocarbonizing or hydrogasifying agglomerating coals. More particularly, this invention relates to a method of preconditioning, by heat treatment and controlling oxidation, agglomerating coil particles in dense phase flow in such continuous processes, to substantially prevent agglomeration of a fluid-bed reaction zone.

DESCRIPTION OF THE PRIOR ART

Increasing energy needs have focused attention on solid fossil fuels due to their availability in the United States in a relatively abundant supply and their potential value if converted into more useful forms of energy and feedstock. Processes such as carbonization gasification, hydrocarbonization and hydrogasification, wherein synthetic fuel products have been prepared by introducing a fluidized stream of finely-divided coal particles into a fluid-bed reaction zone and reacting the coal particles at elevated temperatures in the presence of inert gases, air, steam, hydrogen or the like, are well known. A major operating difficulty in such processes has been the tendency of coal particles, especially intensified in a hydrogen-rich atmosphere, to agglomerate at the elevated temperatures required for reaction.

Coal particles, especially caking, swelling or agglomerating coals, become sticky when heated in a hydrogen-rich atmosphere. Even non-caking, non-swelling and non-agglomerating coals become sticky when heated in such an atmosphere. Coal particles begin to become sticky at temperatures in the range of about 350° C to about 500° C, depending on the specific properties of the coal, the atmosphere and the rate of heating. The stickiness results due to a tarry or plastic-like material forming at or near the surface of each coal particle, by a partial melting or decomposition process. On further heating over a time period, the tarry or plastic-like material is further transformed into a substantially porous, solid material referred to as a "char." The length of this time period, generally in the order of minutes, depends upon the actual temperature of heating and is shorter with an increase in temperature. By "plastic transformation" as used throughout the specification is meant the hereinabove described process wherein surfaces of coal particles being heated, particularly when heated in a hydrogen atmosphere, develop stickiness and transform into substantially solid char, non-sticky surfaces. "Plastic transformation" is undergone by both normally agglomerating coals and coals which may develop a sticky surface only in a hydrogen-rich atmosphere.

Agglomerating or caking coals partially soften and become sticky when heated to temperatures between about 350° C to about 500° over a period of minutes. Components of the coal particles soften and gas evolves because of decomposition. Sticky coal particles undergoing plastic transformation tend to adhere to most surfaces which they contact such as walls or baffles in the reactor, particularly relatively cool walls or baffles. Moreover, contact with other sticky particles while undergoing plastic transformation results in gross particle growth through adherence of sticky particles to one another. The formation and growth of these agglomerates interferes drastically with the maintenance of a fluid-bed and any substantial growth usually makes it impossible to maintain fluidization.

In particular, entrance ports and gas distribution plates of equipment used in fluid-bed coal conversion processes become plugged or partially plugged. Furthermore, even if plugging is not extensive, the sticky particles tend to adhere to the walls of the vessel in which the operation is conducted. Continued gross particle growth and the formation of multi-particle conglomerates and bridges interferes with smooth operation and frequently results in complete stoppage of operation.

Agglomeration of coal particles upon heating depends on operating conditions such as the heating rate, final temperature attained, ambient gas composition, coal type, particle size and total pressure. When heated in a hydrogen atmosphere, even non-agglomerating coals, such as lignites or coals from certain sub-bituminous seams, are susceptible to agglomeration and tend to become sticky in a hydrogen atmosphere. Thus, agglomeration of coal particles is accentuated in a hydrocarbonization reactor where heating in the presence of a hydrogen-rich gas actually promotes formation of a sticky surface on the coal particles reacted. Moreover, in general, introducing any carbonaceous, combustible solid particles, even those that are normally non-agglomerating, to a fluid-bed having an atmosphere tending to induce agglomeration can result in agglomeration and defluidization of the bed.

Various treatments have been suggested to control this agglomerating tendency of coals, including oxidation prior to further high temperature processing. Indeed, the agglomerating tendency of bituminous coals can be completely destroyed if the coal is subjected to sufficient oxidation. However, in such treatment, oxidation at elevated temperatures releases a portion of the vaporizable compounds present in the coal and requires a minimum of from about 10 minutes to 40 minutes of heating. When such oxidized coal is subsequently carbonized, large quantities of realizable volatile materials from the coal are lost, sometimes as much as fifty percent of the entire volatile content. It can be generally stated that each increment in oxidation results in a decrease of realizable tar yield.

In order to use agglomerating coals in low temperature, dry coal carbonization processes and still obtain substantial quantities of liquid products, it has been suggested that the minimum quantity of a fluidized-bed oxidation required to achieve operability of a fluidized low temperature carbonization process for agglomerating bituminous coals occurs when oxidation is carried out in the plastic temperature range of coal for a time period of 10 minutes to 40 minutes in a fluidized-bed. Also U.S. Pat. No. 3,337,417 disclosed a method of pretreating agglomerating coals prior to carbonization wherein the amount of volatile material lost in the oxidation step is reduced; the method comprised preheating the coal in the absence of oxygen to a temperature of from about 390° C to about 420°C; mildly oxidizing the preheated coal with an oxygen-containing gas for a few seconds at a temperature substantially equal to the temperature of the preheated coal; and immediately carbonizing the preheated, oxidized coal.

SUMMARY OF THE INVENTION

It is an object of this invention to prevent the agglomeration of coals at elevated temperatures in a fluid-bed reaction zone of a reactor and thereby providing improved gasification, hydrocarbonization and hydrogasification processes employing such a fluid-bed reaction zone. Another object of this invention is to provide an improved and continuous process for hydrocarbonizing agglomerating coals wherein operation of the fluid-bed hydrocarbonization zone is at elevated pressures and in a hydrogen-rich atmosphere tending to induce agglomeration. Still another object of this invention is to provide a method of preconditioning agglomerating coal particles in dense phase flow at elevated temperatures to maximize coal reaction product unit throughout and minimize the effects of dilution on the reaction product. A further object of this invention is to provide an increased measure of control over the coal conversion process conditions, particularly residence time and temperature, and thereby make practical operation under conditions which tend to maximize the space-time yield.

Briefly, this invention relates, in one aspect, to the discovery that agglomerating coal particles may be rapidly preconditioned in gasification, hydrocarbonization and hydrogasification processes employing a fluid-bed reactor by preheating a dense flow of coal particles to a temperature of about 280° C to about 420° C in the absence of oxygen and then rapidly oxidizing the preheated particles in a standpipe with a similarly preheated oxygen-containing gas. When preheating the particles to a temperature between about 350° C and about 420° C, the preheat time period is maintained sufficiently brief to avoid agglomeration and significant loss of volatiles.

The partial oxidation reaction is exothermic which results in a temperature increase depending on the amount of oxygen used and its degree of reaction. A temperature increase of up to about 80° C per pound of oxygen reacted per 100 pounds of coal oxidized, may typically be expected according to the process of this invention. The temperatures of the coal particles and the oxygen-containing gas are selected so that the coal particles reach a desired end temperature after the oxidation. Moreover, a preheated oxygen-containing gas rapidly effects the chemical reaction oxidizing the coal particles. Since the oxidation reaction is exothermic, the actual oxidation temperature is above the preheated temperature of either the coal particles or oxygen-containing gas. The actual oxidation temperature should be high enough for rapid reaction, preferably above 380° C, but low enough to exclude heavy devolatilization, preferably below about 480° C. For this reason, the temperature to which the coal particles and the oxygen-containing gas are preheated should be selected to obtain an actual oxidation reaction temperature between about 380° C and about 480° C, a temperature within the plastic transformation-temperature of the treated coal particles.

Significant devolatilization of coals during oxidation is avoided by regulating the thermal environment within the oxidation standpipe. One control is selection of preheat temperatures of coal particles and the oxygen-containing gas. Another control depends on the particular coals and temperatures employed and constitutes regulation of the upper limit of the oxidation reaction temperature by intermediate cooling. In some cases, the first control may suffice in preventing significant devolatilization which occurs in general, at an oxidation temperature above about 480° C. In other cases, it is desirable or necessary to employ both controls in combination so that the maximum oxidation temperature is regulated to below the temperature found to significantly devolatilize a particular coal, in general below about 480° C.

Regulation of the thermal environment by intermediate cooling may be accomplished conveniently by the introduction or injection of an inert gas or liquid such as water, preferably atomized in a fine spray, into the oxidation standpipe. Regulation of the thermal environment in such a manner may be unnecessary where the upper limit of the oxidation reaction temperature is below about 480° C. But when the oxidation reaction temperature exceeds about 480° C or when it exceeds a preselected temperature of between about 380° C and about 480° C, regulation by intermediate cooling of the thermal environment should be employed as described hereinabove.

Inert gas or liquid water, oridinarily at ambient temperature, should be introduced into at least one inlet in the upper end of the substantially vertical, oxidation standpipe, and preferably into a multiplicity of such inlets. The temperature of the coolant injected is by definition cooler than the upper limit of the oxidation temperature. Quantities of inert gas or liquid water employed may be automatically regulated by an on-line temperature-responsive regulator. The regulator would regulate the quantities injected into the oxidation standpipe which in turn would relate the upper limit of the oxidation reaction temperature. For illustrative purposes, the regulator may be considered to function much like an oridinary thermostat in opening or shutting off the flow of cooling gas or liquid water via one or more means operating conjunctively and responsive to temperature variations. In this manner, when a predetermined temperature is reached in the oxidation standpipe the regulator may be employed to conveniently regulate the thermal environment in the oxidation standpipe and thereby prevent significant devolatilization.

When reactive coals having low ignition temperatures are employed, a preheat temperature selection between about 280° C and about 350° C is desirable since a temperature rise to between about 350° C and about 480° C in the adiabatic oxidation standpipe is acceptable. Further regulation of the final oxidation temperature attained by these reactive coals will sometime be unnecessary but may, at times, be required.

A preheat temperature between 350° C and about 420° C may be employed for most coals, including unreactive coals, but the temperature reached in the oxidation standpipe is usually excessive. Water or inert gas injection directly into the preoxidizer may be employed during oxidation to regulate the oxidation reaction temperature to a predetermined temperature between about 380° C and about 480° C, preferably between about 400° C and about 420° C. At the point where oxygen in the standpipe is substantially consumed, i.e., the upper end of the oxidation zone, additional liquid water of inert gas may be injected to partially quench the coal particles in order to lower their temperature to about 300° C to about 400° C. Quenching is employed to control devolatilization and facilitate operation of equipment such as valves during subsequent handling such as pressurization, transport and injection into the reactor.

An oxidation time in the vertically elongated standpipe of about 20 seconds to about 300 seconds is possible and about 20 seconds to about 100 seconds is preferred via the method of this invention. This short oxidation time within the plastic transformation-temperature range drastically reduces the coal decomposition. Therefore, the desirable products of the subsequent processing of the coal are recovered and not lost.

In another aspect, this invention relates to an improved continuous hydrocarbonization process wherein fluidized coal particles are rapidly oxidized at a preferred temperature and then introduced at a pressure of about 100 psi to about 1500 psi into a hydrocarbonization reactor with a minimum intermediate cooling and holding time. Pressurization of the fluid coal particles may occur before the oxidation or preferably after the oxidation. Similarly, steam gasification or hydrogasification processes may be improved to handle agglomerating coal by use of this invention.

By the term "hydrocarbonization" as employed throughout the specification, is meant a pyrolysis or carbonization in a hydrogen-rich atmosphere under such conditions that significant reaction of coal and/or partially reacted coal and/or reaction products of coal occurs with hydrogen.

In contrast to carbonization, or simple pyrolysis, one of the principle advantages inherent in hydrocarbonization is the improved control it provides over product yield, quality and distribution. Although product distribution between gas, liquid and solid carbonaceous residue is to a certain extent a function of the nature of the feed coal, the pattern can be altered coonsiderably by variation in the reaction conditions. Moreover, regardless of the yield and/or distribution, as a result of hydrocarbonization, the end products are also more stable than those obtained from the same coal by pyrolysis. Furthermore, the degree of conversion of coals to products other than a solid carbonaceous residue, can also be variedd within certain limits.

The necessity of minimizing the loss of potential volatile products which are to be reacted with hydrogen in the hydrocarbonization zone is thus critical in a hydrocarbonization process. The improved control over product yield, quality and distribution in hydrocarbonization makes it particularly adaptable and integratable into an essentially internally balanced process. Conversion to liquids and gas may be controlled to result in just sufficient residue to satisfy other supportive needs, such as hydrogen production and miscellaneous, high-level, heat energy requirements. By use of the oxidation conditioning of this invention, not only is a hydrocarbonization process improved so that it may handle agglomerating coals, but its efficiency of converting the agglomerating coals to a desired range of products is substantially maximized.

A continuous process for hydrocarbonizing a dense phase flow of coal particles in a fluid-bed reaction zone may be improved in one application of the subject invention. Coal particles, preferably agglomerating particles, are preheated in dense phase flow in the absence of oxygen to a temperature between about 280° C and about 420° C, provided that when the preheat temperature is within the plastic transformation-temperature of the coal particles, i.e., between about 350° C and about 420° C, the preheat time period is sufficiently brief to avoid significant agglomeration of the particles. The preheated coal particles may be pressurized before or after oxidation to a pressure above reaction pressure. Oxidation of the preheated, dense phase flow of coal particles occurs in a standpipe for a time period of about 20 seconds to about 100 seconds with a measured predetermined amount of a preheated oxygen-containing gas, the exothermic heat of the oxidation reaction raising the temperature of the coal particles to a predetermined temperature regulated so that it remains within the plastic transformation-temperature range of the treated coal particles; and speedily introducing at reaction pressure such preheated and oxidized coal particles in dense phase flow into the fluid bed of the hydrocarbonization reactor.

It may be desirable to further lower the temperature of the preheated and preoxidized coal particles, preferably by liquid water injection, to a temperature at which devolatilization is negligable, preferably between about 300° C and about 400° C. Then, the coal particles may be pressurized to a pressure above reaction pressure and speedily introduced into the fluid-bed of the reactor at reaction pressure.

Coal particles behave in a manner similar to or the same as that of a gas or liquid in the fluid-bed reaction zone. The fluid-bed is backmixed. Coal particles remain in the bed for detention times with broad distribution, the time period ranging from seconds to several times the average residence time. Moreover, these detention times are generally independent of particle size.

By "dense phase" as employed throughout the specification, is meant a concentration of solids in fluidizing gas of from about 15 pounds to about 40 pounds of solids per cubic foot of gas.

Coals have been classified according to rank as noted in the following table, Table A.

TABLE A

Classification of Coals by Rank.[a]
(Legend: F.C. = fixed carbon; V.M. = volatile matter; B.t.u. = British thermal units)

| Class | Group | Limits of fixed carbon or B.t.u., ash free basis |
|---|---|---|
| I. Anthracite | 1. Meta-anthracite | Dry F.C., 98% or more (dry C.M., 2% or less) |
| | 2. Anthracite | Dry F.C., 92% or more and less than 98% (dry V.M., 8% or less and more than 2%) |
| | 3. Semianthracite[b] | Dry F. C., 86% or more and less than 92% (dry V.M., 14% or less and more than 8%) |
| | 1. Low-volatile bituminous coal | Dry F.C., 78% or more and less than 86% (dry V.M., 22% or less and more than 14%) |
| | 2. Medium-volative bituminous coal | Dry F.C., 69% or more and less than 78% (dry |

TABLE A-continued

Classification of Coals by Rank.[a]
(Legend: F.C. = fixed carbon; V.M. = volatile matter; B.t.u. = British thermal units)

| Class | Group | Limits of fixed carbon or B.t.u., ash free basis |
|---|---|---|
| | | V.M., 31% or less and more than 22%) |
| II. Bituminous[d] | 3. High-volatile A bituminous coal | Dry F.C., less than 69% (dry V.M., more than 31%) |
| | 4. High-volatile B bituminous coal | Moist[c] B.t.u., 13,000 or more and less than 14,000[e] |
| | 5. High-volatile C bituminous coal[f] | Moist B.t.u., 11,000 or more and less than 13,000[e] |
| III. Sub-bituminous | 1. Sub-bituminous A coal | Moist B.t.u., 11,000 or more and less than 13,000[e] |
| | 2. Sub-bituminous B coal | Moist B.t.u., 9,500 or more and less than 11,000[e] |
| | 3. Sub-bituminous C coal | Moist B.t.u., 8,300 or more and less than 9,500[e] |
| IV. Lignitic | 1. Lignite | Moist B.t.u., less than 8,300 |
| | 2. Brown coal | Moist B.t.u., less than 8,300 |

[a]This classification does not include a few coals that have unusual physical and chemical properties and that come within the limits of fixed carbon or B.t.u. of the high-volatile bituminous and sub-bituminous ranks. All of these coals either contain less than 48% moisture and ash free fixed carbon or have more than 15,500 moist, ash free B.t.u.

[b]If agglomerating, classify in low volatile group of the bituminous class.

[c]Moist B.t.u. refers to coal containing its natural bed moisture but not including visible water on the surface of the coal.

[d]It is recognized that there may be noncaking varieties in each group of the bituminous class.

[e]Coals having 69% or more fixed carbon on the dry, mineral-matter-free basis shall be classified according to fixed carbon, regard-less of B.t.u.

[f]There are three varieties of coal in the high-volatile C bituminous coal group, namely, Variety 1, agglomerating and non-weathering; Variety 2, agglomerating and weathering; Variety 3, nonagglomerating and non-weathering.

Source: A.S.T.M. D388-38 (ref. 1).

As can be seen from Table A above, the present invention finds particular application to the higher ranks coals such as agglomerating sub-bituminous and bituminous classes II and III.

According to the preconditioning method of this invention, agglomerating coal finer than about 8 mesh, preferably finer than about 20 mesh may be pressurized to a pressure sufficient to enter the hydrocarbonization reactor at reactor pressure allowing for a pressure drop in the feed lines. However, it is preferable in many circumstances to conduct the preconditioning method of this invention at substantially atmospheric pressure or moderately superatmospheric pressure and pressurize the coal particles after oxidation and immediately before introducing them into the hydrocarbonization reactor.

The agglomerating coal particles are rapidly preheated in the absence of oxygen to a temperature of from about 280° C to about 420° C, provided that when heated to a temperature between about 350° C and about 420° C, the coal particles are maintained at this temperature before oxidation only for a brief time period to avoid significant agglomeration of the particles. When such preheat temperature is below the plasdtic transformation-temperature of the coal, i.e., between about 280° C and about 350° C, the time at this temperature is not critical. However, when such preheat temperature is within the plastic transformation-temperature of the coil, i.e., between about 350° C to about 420° C, the time at this temperature must be short enough to avoid significant agglomeration and undesirable devolatilization. The time period at this temperature including the time held in an oxygen-free atmosphere before oxidation should not exceed about 10 minutes, and preferably not exceed about 1 minute. When a preheat temperature between about 280° C and about 420° C is employed according to the process of this invention, surface oxidation of the coal particles is rapidly effected.

The coal particles are preferably indirectly heated in dense phase flow. For example, a dense phase flow of the coal particles may be conducted through a tubular heat exchanger having a ratio of heating surface to internal volume that promotes good heat transfer to the solids. In this manner, the coal in dense phase flow can be indirectly heated to a predetermined temperature in less than about 1 minute, preferably in less than about 30 seconds, and more preferably in less than about 15 seconds. It is desirable not to preheat to a temperature greater than about 420° C or excessive volatilization and agglomeration of the coal may result.

Any non-oxidizing gas can be used as the fluidizing gas, e.g., flue gas, fuel gas, nitrogen, steam, hydrogen or the like. A combustible gas such as hydrogen-methane fuel gas can be used since during oxidation, the contained oxygen reacts preferentially with the surfaces of the coal particles. This gives the same stabilization against agglomeration as when the carrier is inert.

The preheated coal particles are then mildly oxidized by exposure to a controlled amount of an oxygen-containing gas in a vertically elongated standpipe. As described herein, coal particles preheated to a temperature within the plastic transformation-temperature of the particles should be oxidized without substantial delay to avoid agglomeration. The temperature of the oxygen-containing gas which contacts the coal particles should be substantially equal to the temperature of the coal particles, i.e., between about 280° C and about 420° C. Suitable oxygen-containing gaseous that may be used in this invention include but are not limited to air, enriched air or an admixture of an inert gas and oxygen. When oxidizing at a pressure above the pressure of the hydrocarbonization reactor, it may be preferable to use preseparated oxygen gas in some cases or use air and separate out the inerts before reaction. This avoids any contamination with nitrogen but requires special safety precautions.

A predetermined amount of oxygen-containing gas is employed, the amount being sufficient to condition the coal particles against agglomeration. The amount of oxygen supplied to the vertical standpipe will affect the rate of oxygen consumed during oxidation. For most agglomerating coals, oxygen should be supplied in an amount sufficient to provide between about 0.5 to about 6 percent by weight based on the weight of the coal, preferably between about 1 to about 4 percent by weight based on the weight of the coal. However, the minimum amount of oxygen necessary to condition the particular coal against agglomeration should be used to maximize the potential yield of volatile products.

The preconditioning of coal particles with oxygen or an oxygen-containing gas may be effected by conducting the preheated coal particles and either oxygen or oxygen-containing gas upwardly through a substantially vertical standpipe. Preferably, the vertically extended standpipe has a relatively narrow diameter. The coal particles are entrained in the gas and carried through the standpipe with it. The fluidization velocity in the standpipe is maintained slightly higher than the free-fall velocity of the largest coal particles employed. The bed is thus a carrying, relatively dilute phase, fluid-bed. By controlling the fluidization velocity in this manner, each coal particle generally makes only about one pass through the standpipe. Because of the properties of such a carrying fluid-bed, a segregation occurs of coal particle sizes, with the larger particles having a considerably longer residence time in the standpipe than the smallest particles. This is highly beneficial in counteracting the natural tendency of the smaller particles, because of their high ratio of surface to volume, to react preferentially. Additionally, the amount of oxygen in the oxygen-containing gas and the fluidization velocity are so controlled that the oxygen is substantially consumed and the coal particles leaves the standpipe substantially free of unreacted oxygen.

The exothermic heat of the partial oxidation reaction brings about a rise in temperature depending on the amount of oxygen used and its degree of reaction. When a predetermined amount of preheated oxygen is used to oxidize the similarly preheated coal, the resultant exothermic reaction typically brings about a temperature increase of up to 80° C per pound of oxygen reacted per 100 pounds of coal oxidized. For example, coal preheated to about 350° C, when oxidized with a predetermined amount of oxygen of about 3 weight percent of the preheated coal similarly preheated to about 350° C, might be brought to a temperature of about 590° C due to the exothermic oxidation. A final coal temperature after oxidation much above the range of about 380° C should be avoided, e.g., by control of the preheat temperature of the coal particles and oxygen-containing gas, or if necessary by introduction of additional inert gas or preferably by water injection, to avoid serious devolatilization of the coal. The degree of control of the preheat temperature depends upon the reactivity of the particular coal to oxygen and temperature at which oxidation begins.

The partial oxidation may occur at a pressure above the reactor pressure or at a pressure only slightly elevated above atmospheric pressure. Inert carrier gases that may be used in the partial oxidation step include steam, nitrogen, flue gas, a hydrogen-containing gas such as process recycle gas or the like. Suitable oxygen-containing gases that may be used enriched the source of oxygen for the oxidation include air, enrichedd air or elemental oxygen. However, if air is used at any pressure, it may be desirable to remove the residual nitrogen gas before pressurizing with process gas in the reactor to avoid diluting the gaseous product. If an inert carrier gas is used, it may also be desirable to displace this gas before introducing the preconditioned coal into the reactor.

From the standpipe, the preheated and oxidized coal particles pass through a solids-gas separator such as a cyclone in which the oxidized coal particles are separated from the inert carrier gas and/or contaminating gases like sulfur dioxide. The inert gas may be vented to the atmosphere or recycled as inert gas carrier. The preheated, oxidized coal particles accumulating in the cyclone may be passed to storage for pressurization to reactor system pressure with, for example, reactor recycle gas. However, it is important to partially quench the preconditioned coal particles, preferably by use of liquid water injection, to a temperature at which loss of volatiles will be negligible. A temperature after quenching of less than about 400° C is desired and between about 300° C and about 400° C preferred. Also, it is important to move the preconditioned and partially quenched coal particles expeditiously to further minimize any possible devolatilization and any further cooling. By moving expeditiously, any more substantial losses of temperature before reaction in the reactor are minimized.

In the hydrocarbonization process of this invention, it is desirable, in general, to perform the oxidation step at a perssure only moderately elevated above atmospheric pressure. After oxidation, the coal particles may be separated from a large amount of inert gas, e.g., by use of a cyclone. Thereafter, the coal particles are pressurized and fed with a hydrogen-rich gas such as hydrogen or a hydrogen-rich recycle gas to a reactor.

A preferred method of transferring the coal particles from the oxidation zone to the reactor zone is by the use of a dry-feeding system employing pressure locks. Other conventional solids transferring means may also be employed if desired in passing the oxidized coal particles from the standpipe to the reactor. Typically, a lock-hopper and fluidized feeder may be used to pressurize and feed the coal particles to the reactor.

The average residence time of the coal particles in the lock-hopper and fluidized feeder system employed is between about 15 and about 60 minutes. Thus, the temperature of the coal particles should be lowered to a temperature where insignificant devolatilization occurs during the average residence time in the dry-feeding system prior to reaction in the reactor. It is desirable to lower the temperature of the char particles to a temperature below about 400° C, and preferably to a temperature between about 300° C and about 400° C in order to continuously operate high pressure, solids handling valves required for pressurization. The temperature of the coal particles is preferably lowered rapidly by quenching to a temperature where continuous operation of valves is possible and devolatilization is negligible. It may also be desirable to lower the temperature of coal particles to between about 300° C and about 400° C, a temperature at which devolatilization is not excessive even when valve limitations are not a problem. Nevertheless, partial quenching after the oxidation step as described hereinabove is necessary for coals in the preheat range above about 300° C.

The preconditioned coal particles are then reacted in a continuous hydrocabonization process, employing known fluidizing techniques, by heating a gas-fluidized bed or stream of the coal. The hydrocarbonization reaction is conducted at a temperature of about 480° C to about 600° C, a hydrogen partial pressure of from about 100 psi to about 1500 psi and an average solids residence time of from about 3 to about 60 minutes. By the term "hydrogen partial pressure," as employed in the specification is meant the log means average of the hydrogen partial pressure in the feed and product gas stream.

The hydrocarbonization reaction which occurs in the presence of hydrogen is exothermic. Therefore, the entering coal particles should have a temperature below or within their plastic transformation-temperature which is also below reaction temperature in order to control the final reaction temperature. This eliminates the need for an additional preheating step after oxidation to raise the temperature of the coal particles to reaction temperature. The temperature of the hydrocarbonization reaction is determined by the heat of reaction, the temperature of the coal feed and the temperature of the feed process gases. Reaction temperature is controlled and increased or decreased by controlling the preheat temperature of the feed process gases. Agglomeration of coal particles is substantially prevented in the fluid-bed zone of hydrocarbonization by the preconditioning method of this invention. Moreover, the yield of recovery volatile products is substantially benefited because of the short oxidation period employed in the preconditioning method of this invention.

In order that the invention may be more fully understood, it will now be described with reference to the accompanying drawings in which.

Figure 1:
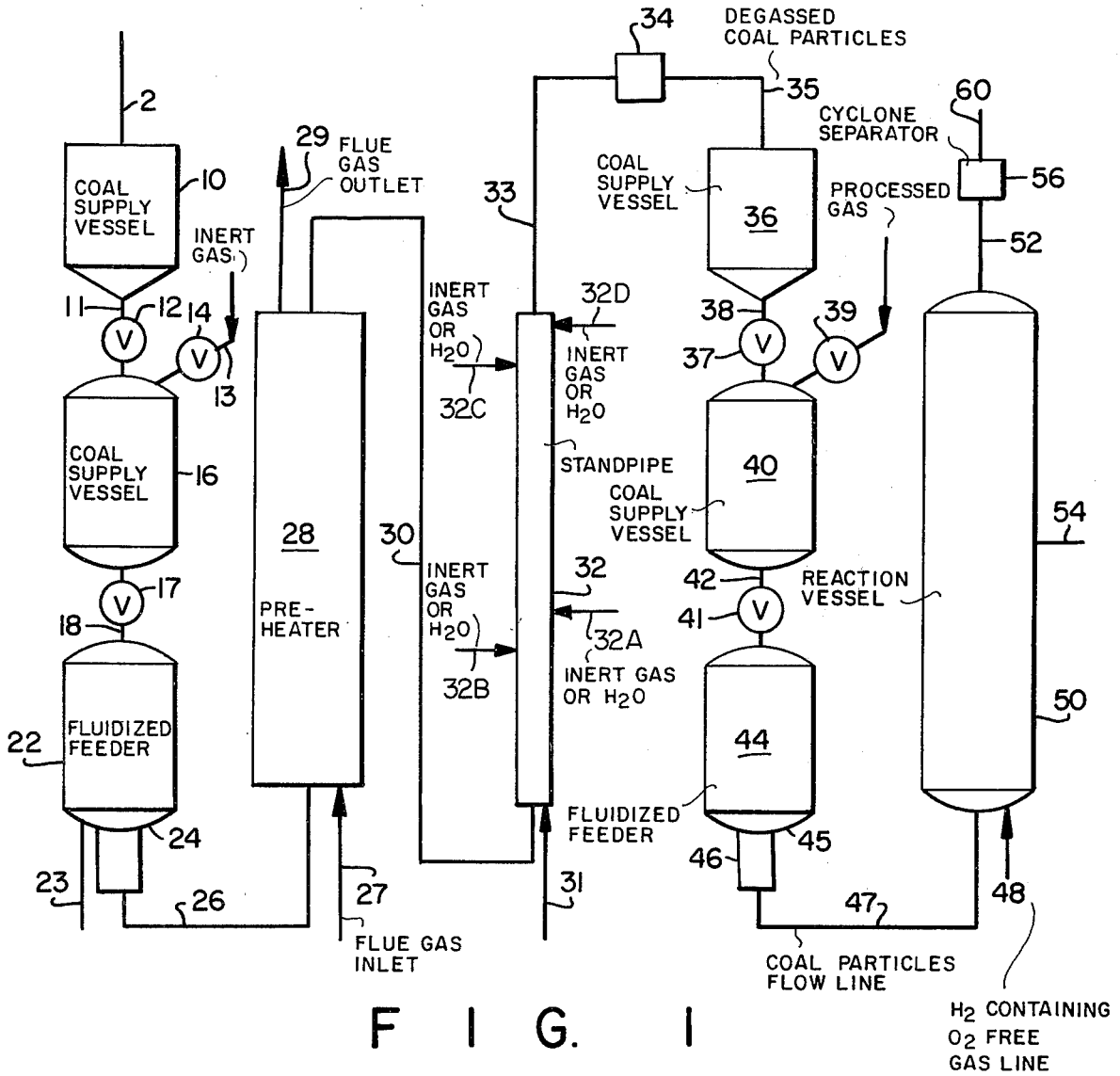
FIG. 1 is a schematic flow sheet of a preferred embodiment of the process of this invention.

FIG. 1 illustrates coal supply vessels 10, 16, 30 and 40, coal feeders 22 and 44, preheater 28, standpipe 32 and reactor vessel 50. Lines are provided for conveying finely divided coal particles through the vessels in sequence. Coal particles are conveyed through line 26 from the pick up chamber 24 to preheater 28. Coal is conveyed through line 30 from preheater 28 into standpipe 32. From standpipe 32, coal is conveyed through line 33 to a solids recovery system 34 (not shown) or to coal supply vessel 36. Coal particles are conveyed through line 47 from the pick up chamber 45 into the reactor vessel 50. Devolatized coal termed char from the reaction vessel 50 is conveyed through line 54 for recovery as solid product or for recycle. Line 52 is provided for conveying liquid and vapor products from the reactor vessel 50 for further processing.

According to the process of this invention, the feed coal is in particulate form having been crushed, ground, pulverized or the like to a size further than about 8 Tyler mesh, and preferably about 20 Tyler mesh or finer. Furthermore, the feed coal should be substantially dry, i.e., free of surface moisture though not necessarily free of adsorbed water. However, the degree of fineness and dryness is not critical to the preconditioning method of this invention. For example, bituminous coal particles sized to pass about 20 Tyler mesh containing 3.5 percent water may be used and many Eastern bituminous coals may require little or no drying. Any such adsorbed water will be vaporized during preheat. Moreover, any such adsorbed water must be included as part of the inert carrying gas and must not be in such large quantities as to give more carrying gas than required.

Coal supply vessels 10 and 16 each can hold a bed of fluidizable size, substantially dry, coal particles employed in the process of this invention. Coal in a particulate form and substantially dry state is fed through line 2 into coal supply vessel 10 where it is transferred into coal supply vessel 16 for pressurization. In coal supply vessel 16, the coal is pressurized with inert gas such as flue gas to a pressure sufficient to carry through the down-stream lines. The pressurized coal particles are then fed through line 18 into a fluidized feeder 22 wherein a fluidizing gas passes through line 23 at a low velocity. The inert gas carrier velocity is sufficient to entrain the fluidizable size coal particles and convey the particles in a dense phase flow as a suspension through line 26 into the bottom of the direct fired coal preheater 28. Alternately, additional gas could be added to line 26 to assist in the conveyance (not shown). Any inert gas, i.e., any non-oxidizing gas, could be used as the fluidizing gas including flue gas, fuel gas, nitrogen, hydrogen or the like.

Operation of vessels 10, 16 and 22 can be illustrated by describing a typical cycle. With valves 14 and 17 closed, lock-hopper 16 is filled to a predetermined depth with coal from lock-hopper 10 through open valve 12 and line 11 at essentially atmospheric pressure. Then, with valves 12 and 17 closed, lock-hopper 16 is pressurized to a predetermined pressure above reaction system pressure through open valve 14 and line 13. Valves 12 and 14 are then closed and coal is introduced into fluidized feeder vessel 22 through open valve 17 and line 18. The cycle about lock-hopper 16 is then repeated. A typical time for such a cycle is from about 10 to about 30 minutes. With valve 17 closed, fluidized coal is fed at a predetermined rate through line 26 to the preheater unit 28. Other variations of the feeding cycle to the fluidized feeder are possible, of course, but they are not illustrated herein since this and other variations do not form the inventive steps of this process.

The direct fired coal preheater 28 is a means to rapidly preheat the finely-divided coal particles, under fluidized conditions, to a temperature of from about 280° C to about 420° C, in the absence of oxygen, provided that the time at a preheat temperature at which the coal particles undergo plastic transformation is sufficiently brief to avoid agglomeration and/or significant devolatilization. At this preheat temperature, surface oxidation of the preheated coal particles occurs rapidly. The coal particles are heated in the preheater 28 to the desired temperature by any convenient means of heat exchanger, e.g., by means of radiant heat or a hot flue gas. In FIG. 1, the hot flue gas is depicted as entering the bottom of preheater 28 through line 27 and exiting at the top through line 29.

From the preheater 28 the heated coal particles pass through line 30 into standpipe 32. The heated coal particles are picked up at the bottom of the insulated standpipe 32 by an oxygen-containing gas from line 31, supplied by a compressor, not shown. The oxygen-containing gas is conveniently a hot flue gas to which sufficient air has been added to give the calculated amount of oxygen for reaction with the preheated coal. The coal particles are entrained in the gas and carried with it through the standpipe 32 into transfer line 33. The fluidization volocity in the standpipe 32 is maintained slightly higher than the free-fall velocity of the largest coal particle so that each coal particle makes only one pass through the pipe. The bed is thus a carrying relatively dilute phase, fluid bed. Because of the properties of such a carrying fluidized bed, a segregation occurs of coal particle sizes, with the larger particles having a considerable longer residence time in the standpipe than the smaller particles. The finer coal particles, with their greater surface area per unit weight and lower free-fall velocity, are in the oxidation zone for a shorter time than the coarser particles. This tends to counteract the tendency of the finer particles to react preferentially and oxidize each particle a substantially equivalent amount.

The partial oxidation which occurs is exothermic and brings about a rise in temperature depending on the amount of oxygen used and its degree of reaction. The oxygen in the oxygen-containing gas is substantially consumed in the standpipe 32. Inert gas or more preferably liquid water, generally at ambient temperature, may be introduced through inlet lines 32A and 32B into standpipe 32 to regulate the maximum oxidation temperture to a predetermined temperature in the range of about 380° C to about 480° C. Although only inlet lines 32A and 32B are illustrated, it is preferred to have at least one inlet line and desirable to have a multiplicity of inlet lines for this purpose. Furthermore, inert gas or more preferably liquid water may be introduced into the upper half of standpipe 32 via inlet lines 32C and 32D, preferably into or near the upper end of standpipe 32 in an amount sufficient to lower the temperature of the coal particles by a partial quench to a temperature range between about 300° C and about 400° C to substantially avoid devolatilization during the following separation, transfer and pressuring steps. Although only inlet lines 32C and 32D are illustrated, it is preferred to have at least one inlet line and desirable to have a multiplicity of inlet lines for this purpose.

From standpipe 32, the oxidized coal particles in a relatively dilute phase pass through line 33 into a cyclone 34 which affects a solids-gas separation. The inert gas, after suitable clean-up of fine solids and/or contaminating gases like sulfur dioxide, is vented or recycled as inert gas carrier. The degassed solid coal particles fall through line 35 into coal supply vessel 36 where they are fed through line 38 and valve 37 into coal supply vessel 40 for pressurization via valve 39. In coal supply vessel 40, the coal particles are pressurized with process feed make-up gas or preferably with reaction recycle gas through open valve 39 to just above the reactor system pressure, which is between about 100 psi and about 1500 psi. The oxidized coal particles should be conveyed expeditiously and without any substantial loss in temperature to the reactor vessel 50. Hence, it is preferable to use a short cycle on the coal supply vessel system, e.g., less than about one hour and to reheat the pressurizing gas to a temperature between about 300° C and 380° C to avoid substantial surface cooling of the preconditioned coal particles.

From coal supply vessel 40, the pressurized coal particles are fed through line 32 and valve 41 into a fluidized feeder 44 wherein a fluidizing gas passes through line 42 at a low velocity. The velocity of the process recycle or make-up gas used as the gas carrier is sufficient to entrain the fluidizable size coal particles and convey the particles in a dense phase flow as a suspension through line 47 into the bottom of reactor vessel 50. Operation of the vessels 36, 40 and 44 is identical to the cycle described herein for operation of vessels 10, 16 and 22.

Hydrocarbonization is effected in the reactor 44, usually at a temperature of about 480° C to about 600° C, a hydrogen partial pressure of about 100 psi and about 1500 psi, and an average solids residence time between about 3 minutes and 1 hour. A heated stream of a hydrogen-containing, oxygen-free gas, is added to the bottom of the reaction vessel 50 through line 48 to fluidize the coal particles and strip them of devolatilization products. The temperature of the hydrogen-containing stream is controlled which in turn operates as a control of the desired temperature in the hydrocarbonization reactor 44. The devolatilization products and gas pass through overhead line 52, which is equipped with a cyclone separator 56 for removal of entrained char particles which are recovered. Gas and tar products may be separated in a gas and tar recovery system 60. The hot devolatilized char is recovered via line 54.

Although the process is illustrated hereinabove employing a hydrocarbonization reaction in reactor 44, it is also within the scope of this invention to employ the controlled oxidation in conjunction with gasification or hydrogasification reactions in reactor 44. A gasification reaction may be effected at a temperature between about 750° C and about 1200° C and at a pressure between about atmospheric and about 1000 psi. A hydrogasification reaction may be effected at a temperature between about 600° C and about 1000° C and at a pressure between about 100 psi to about 1500 psi.

Figure 2:
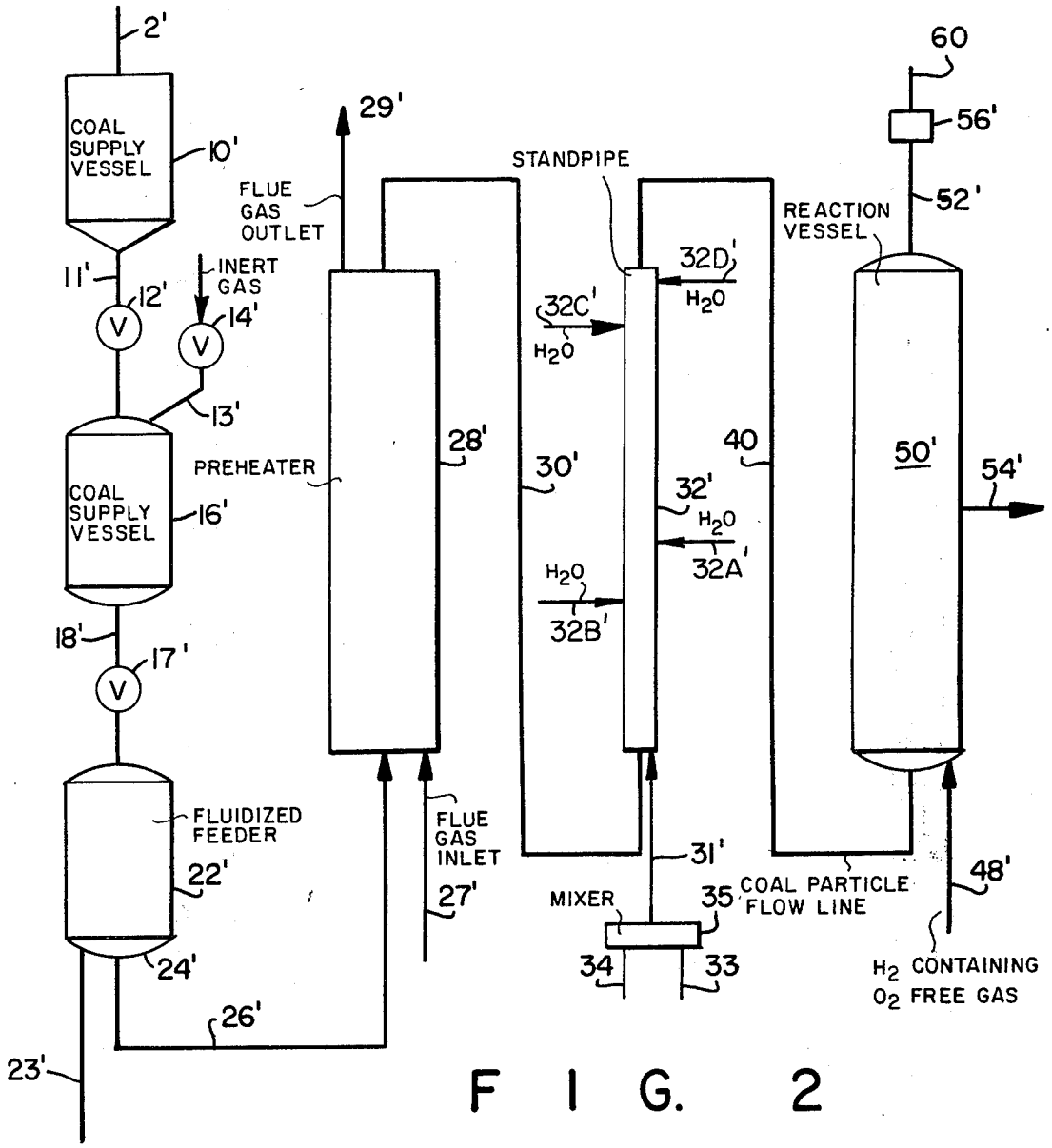
FIG. 2 is a schematic flow sheet of another preferred embodiment of the process of this invention.

FIG. 2 illustrates coal supply vessels 10' and 16', coal feeder 22', preheater 28', standpipe 32', mixer 35 and reaction vessel 50'. Lines are provided for conveying finely-divided coal particles through the vessels in sequence. Line 26' conveys the coal from the pick-up chamber 24' to preheater 28'. Coal is conveyed from preheater 28' into standpipe 32' via line 40 into reactor vessel 50'. A line 54' is employed to convey devolatilized coal, termed char, from the reaction vessel 50' for recovery as solid product or for recycle. Line 52 is provided for conveying liquid and vapor products from the reactor vessel 50' for further processing.

The operation of the process of this invention illustrated in FIG. 2, proceeds in a manner like that described in FIG. 1. Thus, vessel 10', 16', 22', preheater 28', 32' and 50' and valves 12', 14' and 17' correspond to their counterpart vessels and valves in FIG. 1 and operate in essentially the same manner with the following differences. After being preheated in vessel 28', the coal particles are pressurized to a pressure above reaction pressure with mixture of process gas such as reactor cycle gas or make-up gas via line 133 and oxygen via line 134. Contamination with nitrogen is undesirable. Therefore, preferably a pre-separated, nitrogen-free oxygen gas, i.e., essentially pure oxygen, is used. However, the use of such an essentially pure oxygen gas requires special precautions. FIG. 2 shows the oxygen gas introduced into the cold carrier gas through mixer 135 to avoid local explosive mixtures of oxygen-hydrogen-methane.

In the standpipe 32', the oxidation occurs as described hereinafter but at a pressure above reaction pressure. Since it is desirable that the coal particles be at reaction pressure in the reactor the pressurization should allow for a small pressure drop before entering the reactor. Hence, the pressure should be sufficiently above reactor pressure to overcome the pressure drop in feeding the coal particles to the reactor. A pressure drop of between about 50 psi and about 200 psi may be expected. Hence the coal particles and pressurized between about 50 psi to 200 psi above reaction pressure so that they enter the reactor at substantially reaction pressure. From the standpipe 32', the oxidized coal particles at this pressure are introduced into reactor vessel 50' via line 40 in the same manner as described in FIG. 1.

Since the preheated, preconditioned coal particles are transferred to the reactor 50' with minimal detention time, intermediate cooling and/or partial quenching is not, in general, necessary. The temperature of the hydrocarbonization reactor is controlled by heating or cooling and controlling the temperature of the additional process gas from stream 48'. At times, however, it may be desirable to regulate the oxidation temperature, by introducing liquid water into standpipe 32' through inlet lines 32A' and 32B', to a predetermined temperature in the range of about 380° C to about 480° C. Although only two inlet lines are illustrated, it should be understood that at least one inlet line should be employed, when desired, for this purpose, and that a multiplicity of inlet lines may be employed.

What is claimed is:

1. A method of preconditioning coal particles to substantially prevent agglomeration of said particles in a fluid-bed reaction zone of a reactor comprising:

a. preheating a dense phase flow of said particles in the absence of oxygen to a first predetermined temperature between about 280° C and about 420° C for a preheat time sufficiently brief to avoid significant agglomeration of said particles;

b. preheating an oxygen-containing gas to a temperature substantially equal to said first predetermined temperature;

c. introducing said preheated particles and said preheated gas into a vertically elongated standpipe in an upwards direction, said gas having a superficial gas velocity greater than the free fall velocity of the largest of said coal particles, the amount of oxygen in said gas and said superficial gas velocity being controlled so that said oxygen is substantially consumed exothermically, the amount of said oxygen in said gas being between about 0.5 and about 6 weight percent of said particles the exothermic oxidation increasing the temperature of said particles up to 80° C per weight percent oxygen to said particles, said particles leaving said standpipe in about 20 seconds to about 300 seconds;

d. regulating the oxidation temperature of said particles within said standpipe to a second predetermined temperature between about 380° C and about 480° C, a temperature within the plastic transformation-temperature of said particles;

e. introducing said oxidized particles at said second predetermined temperature into a cooling zone wherein the temperature of said particles is regulated to a third predetermined temperature between about 300° C and about 400° C;

f. pressurizing said oxidized particles to a pressure above the pressure in said reaction zone; and g. introducing said particles into said reaction zone, whereby agglomeration of said particles in said zone is substantially prevented as said particles react at reaction pressure with a reagent.

2. A method as defined in claim wherein said particles are agglomerating sub-bituminous or bituminous coal particles, said reagent is a hydrogen-containing, oxygen-free gas; said reaction zone operates at a reaction temperature between about 480° C and about 600° C, a hydrogen partial pressure between about 100 psi and about 1200 psi, and a solids residence time between about 3 minutes and about 1 hour; and saidoxidation time in said standpipe is between about 20 seconds and about 100 seconds.

3. A method as defined in claim 2 wherein said oxygen-containing gas is air.

4. A method as defined in claim 1 wherein said first predetermined temperature is between about 280° C and about 350° C.

5. A method as defined in claim 1 wherein said first predetermined temperature is between about 350° C and about 420° C and the time at said first predetermined temperature does not exceed about 10 minutes.

6. A method as defined in claim 5 wherein the time at said first predetermined temperature doe not exceed about 1 minute.

7. A method as defined in claim 1 wherein said oxidation temperature is regulated by the introduction of a coolant selected from the group consisting of an inert gas and a liquid into said standpipe.

8. A method as defined in claim 7 wherein said coolant is a liquid and said liquid is water.

9. A method as defined in claim 8 wherein said coolant is a liquid and said liquid is water.

10. A method as defined in claim 7 wherein said cooling zone comprises the upper end of said standpipe and the temperature of said particles is regulated by introducing a coolant selected from the group consisting of an inert gas and a liquid into the upper end of said standpipe.

* * * * *

UNITED STATES PATENT OFFICE

CERTIFICATE OF CORRECTION

Patent No. 4,002,535 Dated January 11, 1977

Inventor(s) Charles W. Albright et al.

It is certified that error appears in the above-identified patent and that said Letters Patent are hereby corrected as shown below:

Column 1, line 10, "coil" should read -- coal --

Column 5, line 36, "variedd" should read -- varied --

Column 10, line 34, "perssure" should read -- pressure --.

Signed and Sealed this ninth Day of August 1977

[SEAL]

Attest:

RUTH C. MASON
*Attesting Officer*

C. MARSHALL DANN
*Commissioner of Patents and Trademarks*